United States Patent [19]

Fitzgerald et al.

[11] 4,311,940

[45] Jan. 19, 1982

[54] ELECTRIC INCANDESCENT LAMP

[75] Inventors: John Fitzgerald; Willem L. Van Hoorn, both of Eindhoven, Netherlands

[73] Assignee: U.S. Philips Corporation, New York, N.Y.

[21] Appl. No.: 118,167

[22] Filed: Feb. 4, 1980

[30] Foreign Application Priority Data

Mar. 14, 1979 [NL] Netherlands ..... 7902016

[51] Int. Cl.[3] ..... H01J 1/88; H01J 19/42; H01K 1/18

[52] U.S. Cl. ..... 313/273; 313/271; 313/115

[58] Field of Search ..... 313/271, 273, 112, 115, 313/317

[56] References Cited

U.S. PATENT DOCUMENTS

| | | | |
|---|---|---|---|
| 2,784,338 | 3/1957 | Woodward et al. | 313/315 |
| 3,445,713 | 5/1969 | Cardwell, Jr. | 313/115 X |
| 3,543,962 | 12/1970 | Peterson | 313/273 |
| 3,909,653 | 9/1975 | Bottone et al. | 313/273 |
| 4,023,060 | 5/1977 | Pike et al. | 313/273 |
| 4,079,283 | 3/1978 | George | 313/273 |

*Primary Examiner*—Saxfield Chatmon, Jr.
*Attorney, Agent, or Firm*—Robert S. Smith

[57] ABSTRACT

In electric incandescent lamps the efficiency can be increased by surrounding the filament with a light-pervious, infra-red radiation-reflecting filter. It has hitherto always been assumed that the geometry of the filter and that of the filament should be well matched to each other. This, however, results in a complex filament construction.

According to the invention, near the center of a spherical filter, a flat filament consisting of several parts is accommodated, being situated within a square the sides of which are from 0.25 to 0.04 times the diameter of the filter. Such a filament has a relatively simple construction and provides a highly efficient lamp despite the fact that its geometry is very different from that of the filter.

2 Claims, 2 Drawing Figures

ELECTRIC INCANDESCENT LAMP

Figure 1:
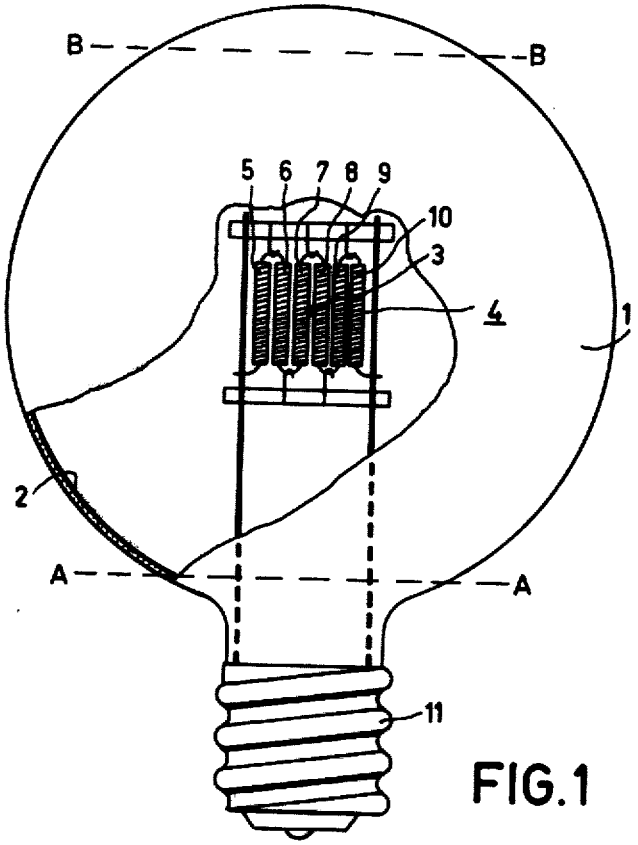

The invention relates to an electric incandescent lamp having a substantially spherical lamp envelope whose wall is provided with a light-pervious, infrared radiation-reflecting filter, and in which a filament is accommodated near the center of the lamp envelope.

Such a lamp is disclosed in German Offenlegungsschrift No. 2,811,037 which states that the filament preferably is also spherical. All the infrared radiation reflected by the filter is returned on the filament as a result of which less electrical energy is required to maintain this at a high temperature and the lamp has a higher efficiency.

Since it is impossible to manufacture a spherical filament according to the said Offenlegungsschrift it is endeavoured to use a compact filament the geometry of which approaches that of the lamp envelope as much as possible. However, this endeavour results in complicated filaments which can be supported only with particular difficulty in such manner as to maintain their initial shape during the life of the lamp.

However, the resistance to deformation of the filament is of essential importance. In fact, with matching geometries, a reproduction of the filament is formed on the filament by the filter and if the filament does not maintain its initial shape, it will not be heated uniformly by the reflected infrared radiation as a result of which the life of the lamp is shortened.

It is the object of the invention to provide such a lamp having a filament which is easy to manufacture and to accommodate.

In lamps of the kind mentioned in the opening paragraph this object is achieved in that the filament is a flat folded filament of helically wound wire and is situated within a square having a sidelength between 0.25 and 0.04 times the inner diameter of the lamp envelope.

Therefore, in contrast with the known lamp, it is not endeavored in the lamp of the invention to approach a spherical filament. Consequently, no reproduction of the filament is formed by the filter. The filament is rather exposed to a diffuse pattern of radiation. The great advantage of the construction according to the invention is that defects in the shape of the lamp envelope and irregularities in the wall surface on which the filter is provided exert a very small influence on the efficiency of the lamp. Nor is the position of the filament very critical. Positioning of the filament at a distance from the center of the lamp envelope of a few percent of the diameter of the lamp envelope only gives a very small loss of efficiency.

Furthermore, in contrast with the known lamp, in the lamp according to the invention there is no conformity between the geometry of the filament and the geometry of the filter.

The filament may consist of a number of straight parts which are accommodated in one plane. However, the parts of the filament may alternatively be divided over two mutually parallel planes. Such planar and biplanar filaments, respectively, can easily be manufactured.

The parts of the filament are accommodated so as to be so close together that the filament is optically dense to a large extent, that is to say that less than 50% of the infrared radiation returned by the filter can pass through the filament. In biplanar filaments, the parts of the filament in one plane are therefore preferably accommodated so as to be staggered with respect to the parts of the filament in the other plane. However, restrictions are imposed upon the optical density of the filament as a result of the necessity of having to prevent flash-over from occurring between adjacent parts of the filament.

It has been found that the power consumed by a lamp is minimum if the filament is bounded by a square of which the length of the sides is from 0.15 to 0.05 times the diameter of the lamp envelope.

The lamp according to the invention is notably suitable for line voltage lamps of high power, for example 100 W and more.

Filters of varying natures may be used in the lamp according to the invention. For example an interference filter may be used whether or not in combination with a metal-doped metal oxide filter, for example, a filter disclosed in U.S. Pat. No. 4,017,758. Alternatively, a filter may be used as described in the above-mentioned German Offenlegungsschrift or in the corresponding U.S. Pat. No. 4,160,929 which is incorporated herein by reference. Such a filter consists, for example, of a layer of silver between two layers of $TiO_2$. Filters of this kind have also been described in literature: for example, in Applied Physics Letters, Vol. 25, No. 12, 693–695 (1974). They can be manufactured by means of conventional methods, such as dipping, spraying, or vapour depositing. If desired, the lamp envelope may be constructed from two parts, for example, hemispheres. The filter is preferably provided on the inside of the lamp envelope.

Figure 2:
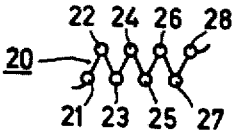

An elevation, partly broken away, of an embodiment of a lamp according to the invention is shown in FIG. 1 and FIG. 2 is a plan view of a biplanar filament.

Reference numeral 1 in FIG. 1 denotes the lamp envelope which is spherical for the greater part and which has a light-pervious, infrared radiation-reflecting filter 2 on its inside. A flat filament 4 consisting of several parts and of helically wound wire is accommodated around the center 3 of the spherical lamp envelope. The parts of the filament are referenced 5, 6, 7, 8, 9, 10. The lamp has a lamp cap 11. The filter on the part of the lamp envelope below the line A—A, as well as the filter above the line B—B only provides a very small contribution to the efficiency of the lamp, because the radiation emitted towards these parts is a very small fraction of the totally emitted radiation. It is therefore advantageous to operate the lamp vertically, either with the lamp cap uppermost or with the lamp cap lowermost. Material evaporated from the filament will then deposit on one of these parts. The associated reduction of the light transmitting power and of the infrared radiation-reflecting power then has substantially no effect on the efficiency of the lamp.

In this Figure the flat folded filament is situated within a square having a side length between 0.25 and 0.04 times the inner diameter of the lamp envelope. In the case the envelope would have a much larger diameter, local deviations in the form of the lamp envelope, such as irregularities of its inner surface, would have a considerable impact on the amount of irradiation reflected to the filament. On the other hand an envelope having a much smaller diameter would also detrimentally influence the efficiency of the lamp, because the filter provided on its inner surface would produce a strongly enlarged reproduction of the filament.

In FIG. 2, the parts 21, 23, 25 and 27 of filament 20 are situated in a first plane, the parts 22, 24, 26 and 28 in a second plane parallel thereto.

EXAMPLE

In a practical case the lamp envelope had an inside diameter of 150 mm and was covered with $TiO_2$ (18 nm), Ag (18 nm) and $TiO_2$ (18 nm). Near the center of the lamp envelope a flat biplanar filament consisting of 10 parts was accommodated, the parts each having a length of 9.5 mm and the overall width of the filament being 11 mm. The filament was wound with a pitch of 130 μm of wire of 120 μm. The lamp was operated at 148 V and consumed a power of 225 W. The temperature of the filament was 3200° K. The same lamp without a filter on the wall of the lamp envelope operated at the same temperature at a voltage of 220 V and consumed a power of 500 W. The lamp with the filter therefore consumed 55% less power. When the filament was displaced over a distance of 5 mm in any direction, the lamp continued consuming well over 50% less power.

What is claimed is:

1. An electric incandescent lamp having a substantially spherical lamp envelope whose wall is provided with a light pervious, infrared radiation-reflecting filter and in which a filament is accommodated near the center of the lamp envelope, characterized in that the filament is a flat folded filament of helically wound wire and is situated within a square having a side length between 0.25 and 0.04 times the inner diameter of the lamp envelope.

2. An electric incandescent lamp as claimed in claim 1, characterized in that the filament is situated within a square the sides of which are from 0.15 to 0.05 times the diameter of the lamp envelope.

* * * * *